US005479746A

United States Patent [19]

Mannonen

[11] Patent Number: 5,479,746

[45] Date of Patent: Jan. 2, 1996

[54] COMPONENT FOR THE CONSTRUCTION OF GROUND-BEARING STAIRWAYS AND RAMPS AND COMPONENTS FOR EMBODYING SAME

[75] Inventor: Matti P. Mannonen, Helsinki, Finland

[73] Assignee: Trioplan Oy, Helsinki, Finland

[21] Appl. No.: 585,054

[22] PCT Filed: Apr. 11, 1989

[86] PCT No.: PCT/FI89/00068

§ 371 Date: Dec. 5, 1990

§ 102(e) Date: Dec. 5, 1990

[87] PCT Pub. No.: WO89/09856

PCT Pub. Date: Oct. 19, 1989

[30] Foreign Application Priority Data

Apr. 12, 1988 [FI] Finland ..... 881691

[51] Int. Cl.[6] ..... E04F 11/14

[52] U.S. Cl. ..... 52/182; 52/189; 52/596; 52/603; 52/612

[58] Field of Search ..... 52/182, 183, 189, 52/190, 191, 596, 603, 612; 405/284, 285, 286

[56] References Cited

U.S. PATENT DOCUMENTS

| | | | |
|---|---|---|---|
| 1,370,718 | 3/1921 | Walters | 52/190 |
| 1,756,351 | 4/1930 | Gentile | 52/190 |
| 2,577,864 | 12/1951 | Thornton et al. | 52/190 |
| 2,672,045 | 3/1954 | Alcini | 52/190 |
| 3,343,316 | 9/1967 | McIntire | 52/190 |
| 4,516,368 | 5/1984 | Pichler | 52/190 |
| 4,655,018 | 4/1987 | Pardo | 52/602 |
| 4,818,150 | 4/1989 | Jaecklin | 405/262 |

FOREIGN PATENT DOCUMENTS

| | | | |
|---|---|---|---|
| 2268116 | 11/1975 | France . | |
| 806161 | 3/1951 | Germany | 52/190 |
| 3517337 | 11/1986 | Germany . | |
| 595471 | 7/1959 | Italy | 52/190 |

*Primary Examiner*—Carl D. Friedman
*Assistant Examiner*—Kien Nguyen
*Attorney, Agent, or Firm*—Pennie & Edmonds

[57] ABSTRACT

The invention relates to a prefabricated concrete component system for forming ground-bearing stairways, platforms, terraces and analogous structures of one or more layers. It is the object of the invention to be able to construct, from a few basic components, a durable and safe ground-bearing structure of the desired shape. Such a component system comprises at least three different basic components (1, 2, and 3), which are used together or separately and which are slab components provided with upright supports. The basic components of the component system according to the invention are so designed that one or two adjacent slab components in the same constructional layer form at least two support and fastening surfaces for the next higher slab component. Thus a sturdy and safe structure is obtained. The shape of the components enables them to be cast in a single-part casting mold, from which the component will detach owing to vertical surfaces. The system also includes ramp components, edge components provided with edges, and corner components.

5 Claims, 7 Drawing Sheets

COMPONENT FOR THE CONSTRUCTION OF GROUND-BEARING STAIRWAYS AND RAMPS AND COMPONENTS FOR EMBODYING SAME

The present invention relates to a component system made up of prefabricated concrete components which are assembled and fastened to each other in a suitable manner to form ground-bearing stairways, platforms, terraces, and similar structures in pedestrian areas and in the surroundings of buildings, for example in connection with entrances.

The use of various so-called landscaping products made of concrete is rapidly increasing in Europe and also in Finland. This increase is due to the general trend in the building industry into shift to the factory as large a proportion as possible of the work to be done, as compared with in situ building.

Nowadays, short flights of stairs or a few ground-bearing steps are most commonly assembled from concrete products manufactured for other purposes, such as rectangular slab and block pavings and curbstones. There is often the disadvantage of unsuitable dimensioning, inferior appearance, and, as a safety decreasing factor, the fact that the parts cannot be fastened to each other in a durable manner. This has inhibited the construction of long, steep but safe heavy-use flights of stairs from separate parts.

For this reason, ground-bearing stairways are today mostly cast in situ in one place. The disadvantages of in-situ casting include high cost, especially in winter conditions, a low quality of the visible surfaces, and the difficulty of achieving sufficient resistance to freezing temperatures as regards the concrete. Under factory conditions, control is more thorough, ensuring higher quality. Attempts are often made to improve the outer appearance by cementing concrete slabs to the steps, which for its part complicates the work.

Simple separate step components and retaining-wall components, as well as curbstones, have been available on the market. However, owing to dimensional and shape incompatibility and to differences in color, it is impossible to assemble these separate parts into a neat structure.

The accompanying FIGS. 1–5 depict the ground-bearing stairway components currently used. They have a great disadvantage in that they cannot be fastened to each other to form framework structures. The ground underneath will serve as the loadbearing structure. Their installation is difficult and slow. In addition, the structure is subject to ground shifts, for example to frost heave.

It is the object of the present invention to overcome the disadvantages mentioned above and to provide a component system which fulfills the functional and production-technique requirements listed below:

Because of the risk of shifts in the sub-base it must be possible to fasten the parts to each other and to overlap them. This is both a structural durability requirement and the user's safety requirement. The fastening points must remain hidden in the completed structure;

- the visible surfaces must be acceptable in terms of quality, and, in particular, the surfaces to be walked on must not be slippery;
- the concrete must be resistant to freezing temperatures and to road salt;
- it must be possible to construct ground-bearing stairways, intermediate landings, ramps, and inner and outer corners from only a few basic components of different shapes;
- in terms of production technology, the design of the products must be such that the molds required are single-part molds in order that the products can be cast like "sand cakes" from zero-slump concrete. In addition, the visible surfaces must be cast against the mold in order to achieve a high-standard outer appearance and non-slippery surface.

The idea of the component system according to the invention is thus that, in one and the same layer of the component structure, either the upright supports of a single slab component, possibly the only upright support of the slab component together with the surrounding ground, or the upright supports of two adjacent slab components constitute at least two support and fastening surfaces for a slab component in the next higher layer. Exceptionally, two adjacent slab components form three support and fastening surfaces for a slab component in the next higher layer. The component which is disposed on top is fastened to these support and fastening surfaces by nailing, for example shooting, by means of a wedge bolt, or by a corresponding method based on drilling a hole, or by cementing. The fastening point will be concealed by the slab component to be placed on top. Cementing is advantageous especially in the edge slabs of the top landing and in intermediate landings, where the fastening must not be visible.

The upright support of a slab component preferably consists of a ridge parallel to its front and rear edges. The ridge preferably extends across the entire slab component.

According to a preferred embodiment of the component system, all of the components have the same width.

According to a preferred embodiment of the slab component, its dimensioning is such that the width of the slab component, i.e. its dimension in the direction of, for example, the width of the stairs, is twice the tread of the structure, i.e. the overlap of the structure in the direction of depth. This is necessary in order to achieve the structure of the outer and inner corners of stairways and platforms in such a way that the same pitch and overlap continue at an angle of 90° in relation to the original direction of the tread.

Instead of an upright support in the form of a straight ridge, the corner components have an upright support which forms a corner.

The width of the slab components which are to be placed at the edges of the structure is the same as the width of the other slab components, or half of it. The edge components have edges of the height of the upright support in order to produce a closed wall structure.

All of the mutually opposite upright surfaces of a slab component, i.e. all the side walls of the upright supports and of the slab component itself, are preferably inclined upwards and inwards. This inclined portion is obtained in the upright surfaces such that it is possible to use single-part casting molds. This means that the mold need not be opened for removing the slab from the mold, inverting the mold or pushing the casting through the mold will suffice.

In connection with the casting it is possible to produce an anti-slip roughening, either in the mold itself or by using negative surface retarders, i.e. so-called "exposed-aggregate finish".

The component system according to the invention preferably comprises basic components of two different types, i.e. step components and inner components. Extending in a vertical direction from one end of the upper surface of the step component there is an upright support at the end of the step distance, i.e. the tread, and the step component to be placed on top of this component will start there. Vertically successive step components will form the steps in the structure. The inner component has two upright supports fitted symmetrically in relation to the center line of the inner component, and the depth of the inner component is preferably twice the tread, i.e. the step length. Since the width of the components is preferably twice the tread of the structure, the inner component is thus preferably square. The inner part of the structure is built using inner components, and they are thus disposed next to the components closest to the edge, which are either step components or other edge components. Inner components are preferably used turned 90° about their vertical axis in vertically successive layers, whereby a considerably more advantageous distribution of loads will be obtained.

There are preferably two different types of step components. One of the components has the same length as the inner component, i.e. twice the tread, and the other has 1.5 times the length of the inner component, i.e. three times the tread. The former has only one upright support and the other one has two, one of the upright supports being located at or close to the rear end of the component. By selecting the depths of the step components so as to correspond to 2 or 3 times the tread, various adjusting pieces in the edges of the structure, in the intermediate layers and in the ramps are avoided. Even shorter step components can be used.

In addition, the component system according to the invention includes ramp components for forming ramps between the various height levels. There are preferably two types of ramp components. One is a single-part component and has the same length as the inner component and forms a steep ramp. The other has two or more parts and has a total length which is a multiple of that of the inner component, and it forms a gently sloping ramp. The steep ramp component has a shoulder serving as an upright support at the tread distance from the front edge. The part between the shoulder and the front edge forms a sloped surface which runs from the bottom level of the slab to the shoulder, to a level slightly higher than the shoulder, corresponding to the step level of the component to be placed on top. The parts of the gently sloping ramp component have the length of the inner component, and the highest part has a shoulder serving as an upright support at the tread distance from its front edge. The ramp parts together form a continuous sloped surface which runs from the front edge at the bottom level of the slab, to the shoulder, to a level somewhat higher than the shoulder, corresponding to the step level of the component to be placed on top. The upright walls of the ramp components are slightly inclined upwards and inwards, and they are cast in the same manner in single-part casting molds. The visible sloped surface is formed against the wall of the casting mold and is thus in accordance with the mold, and neat.

The components may be made heatable so that it will be possible in the winter to melt ice from their surface. The heating may be carried out, for example, by using electric resistors placed between those upright supports of the step components which are closest to the edge. In the case of a flat-structure made from the components, all of the components may be heatable by electric resistors placed under them.

To supplement the components mentioned above there are needed flat surface slabs the width and length of which correspond to the dimensioning of the inner components and the edge components.

Prior-art concrete ground-bearing stairway components, as well as preferred embodiments according to the present invention, are described below with reference to the accompanying figures, in which FIGS. 1–5 depict the prior-art concrete ground-bearing stairway components which were already described above, FIG. 1*a* depicts a step component provided with two upright supports, FIG. 1*b* depicts a step component provided with one upright support, FIG. 1*c* depicts an inner component, FIG. 2*a* depicts an edge component corresponding to the inner component, FIG. 2*b* depicts a half of an edge component, FIG. 3*a* depicts a steep ramp component, FIG. 3*b* depicts a gently sloping two-part ramp component, FIG. 4*a* depicts a vertical section of an inner corner component, FIG. 4*b* depicts a plan view of an inner corner component, FIG. 4*c* depicts an inner corner component in a stairway corner structure, FIG. 5*a* depicts a vertical section of an outer corner component, FIG. 5*b* depicts a plan view of an outer corner component, FIG. 5*c* depicts an outer corner component in a stairway corner structure, FIGS. 6–8 depict ground-bearing stairways constructed by using the various components, FIG. 9 depicts a ground-bearing intermediate landing, FIG. 10 depicts a ground-bearing ramp structure, FIG. 11 depicts a platform, FIG. 12 depicts another embodiment of the platform according to FIG. 11, FIG. 13 depicts a section, through A—A, of the platform according to FIG. 12, FIG. 14 is a perspective representation of a flight of stairs embedded in the ground and trimmed using edge components, FIG. 15 is a perspective representation of a planting platform and platform stairs constructed in connection with it.

In the figures, the same parts are indicated with the same reference numerals. A step component provided with two upright supports is indicated by reference numeral 1, a step component provided with one upright support 11 with numeral 2, an inner component with numeral 3, an inner component having an edge 17 with numeral 4, an inner-component half with an edge 17 with numeral 5, a steep ramp component with numeral 6, the support part of a gently sloping two-part ramp component with numeral 7, and its extension part with numeral 8, an inner corner component with numeral 9, and an outer corner component with numeral 10. The bottom surface of the slab is indicated by number 12 and the upwards and inwards inclined upright walls of the components are indicated by number 13.

FIGS. 1*a*–3*b* show clearly the shapes of the individual basic components and their mutual dimensional proportions. All of the upright surfaces 13 are inclined upwards and inwards, which enables the components to be cast in single-part molds, inverted with respect to the figures. The cast products will detach from the molds owing to their inclined sides 13 when the molds are inverted. This considerably simplifies the manufacture of the components.

Owing to this manufacturing method, all the visible surfaces, such as the step surfaces and the ramp surfaces, are smooth and provided with the desired roughening pattern, since they are formed against the walls of the casting molds. In connection with the casting there is obtained, in addition to the roughening, also any desired rounding of the noses of the step surfaces and possibly other edges. The rounding of the nose is the most visible of them. The rounding of the lower edges can, when so desired, be done in connection with the casting. Since the casting of the components takes place indoors under controlled conditions, their quality will be maximally high.

When stairways are built, the rise and the tread of a step depend on each other and they have clear practical limit values. The higher the rise, the shorter is the tread. Each selected rise-tread combination thus has its own dimensional series of all components.

The dimension series depicted in the figures illustrates a preferred rise to tread ratio, in which the tread is 400 mm and the rise 150 mm. The depth of the step, which is the same as the tread, is thus 400 mm, and the width of the components is a multiple of the tread, preferably twice the tread, i.e. 800 mm. To produce corner structures, the width must be twice the tread in order that the same pitch and overlap can continue at an angle of 90° to the original direction of the tread. The depth of the inner component is twice the tread, i.e. 800 mm, and the same as the depth of the step component provided with one upright support. The depth of the step component provided with two upright supports is 1200 mm. The thickness of the upright supports in the depth direction of the component is approximately 70 mm, and their mutual distance in the inner component is 170 mm and distance from the edges 245 mm. The thickness of the slab is approximately 50 mm. With this dimensioning, the weight of each component is less than 150 kg, and they are thus capable of being handled manually by using suitable auxiliary tools.

FIGS. 4*a* and 5*c* show the structure of stairway corners.

FIG. 4*c* depicts an inner stairway corner and FIG. 5*c* and outer stairway corner.

The width of the step components is the same as twice the tread, i.e. the same as their depth. To form straight stairway edges there are additionally needed halves of step components, i.e. components of half the width dimension.

FIGS. 6–8 depict different solutions for ground-bearing stairways. FIG. 6 depicts a structure on a gently sloping terrain, FIG. 7 on a slightly steeper terrain, and FIG. 8 on a steep terrain. All the stairways have been constructed using the same basic components, i.e. with the same rise to tread ratio.

In the gently sloping structure, nothing other than step components 1 with two upright supports have been used. The sub-base used for the components is gravel, which is compacted under the components. The figure shows that each component is supported where they be on two points, i.e. at the upright supports of the component underneath these points are indicated by black triangles in FIGS. 6, 7 and 8. The lowest component is ground-bearing. Vertically successive components are fastened to each other at these supporting points. The top layer as well as the paving in front of the stairs are made from ordinary concrete slabs. The slab fitted on top of the step component is fastened by cementing to the upper surface of the upright supports. Thus also the fastening of the top slab will be invisible. The adhesive used may be conventional concrete adhesive such as cement, bitumen cement or epoxy cement.

The stairway of FIG. 7 constructed on a terrain steeper than the terrain described above has been made from step components 2 provided with one upright support and from inner components 3. Located symmetrically in relation to the center line 2 of the component, the upright supports of the inner component 3 each support a separate upper component, i.e. in the case shown in the Figure the step component 2 and the inner component 3. In the lowest layer of components and in the middle layer there are two adjacent components 2 and 3, whereas the top layer has only one step component. The top layer does not require two adjacent components, since the load on it is small. Since this embodiment is a stairway structure, the component is always a step component. Each component is again supported at two upright supports underneath and is thus firmly in place. The fastening is done, for example, by nailing at concealed points or by cementing at visible points. At the foot of the stairway and at its upper end there are conventional slabs.

In FIG. 8, the stairway constructed on a steep terrain has been formed from three different basic components 1, 2 and 3. The only component 1 of the middle step is exceptionally supported at three points. The top step layer again has, because of the small load, only one step component 2, provided with one upright support. If more steps were needed, the construction could be continued inwards in order to provide sufficient support for the structure. An inner component 3 would be suitable as a continuation of the component 3 in the lowest layer and as the continuation of the component 1 in the middle layer. In this case the step component 2 of the topmost layer should be replaced by a step component 1. A step component 2 would again be suitable as the topmost additional step.

The three basic components described thus suffice for the construction of ground-bearing stairways of any shape.

FIG. 9 depicts a simple intermediate-landing structure and FIG. 10 a ramp structure applied to a slight rise of terrain. Since the ramp components 6, 7 and 8 have the same basic dimensioning as the step component with one upright support and the inner component, they can be used in any top layer of the structure, side by side with step components and flat slabs. The ramp components differ from the other basic components in that they have an even, sloped surface. In the parts 6 and 7 this surface extends sufficiently higher than the upright support so that the top surface is at the same level as the step level of the next component layer. Thus the ramp surface forms a smooth cross-over bridge between two components at different levels. The sloped upper surface ends at the front edge of the upright support and thus forms a shoulder on which the component of the next layer will bear. The continuation part 8 of the two-part ramp component does not have said shoulder; the continuation part joins its front part 7 so that the sloped surfaces of both form a continuous smooth sloped surface.

FIG. 11 depicts the structure of a platform. The only building components used are inner components 3 and edge components 4 and 5, of two lengths.

FIG. 12 depicts a platform according to another embodiment, which is built from inner components 3 and edge components 4 and 5, and in which the components of the middle inner component layer are turned 90° horizontally. This provides for a substantially more advantageous distribution of loads and, furthermore, reduces the need for different edge components.

Figure 1:
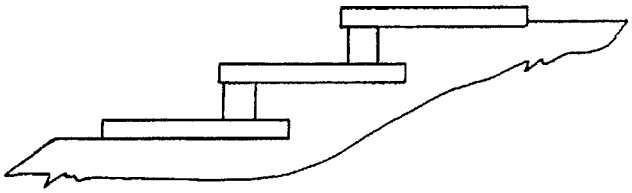
FIG. 1 Prior Art
Figure 2:
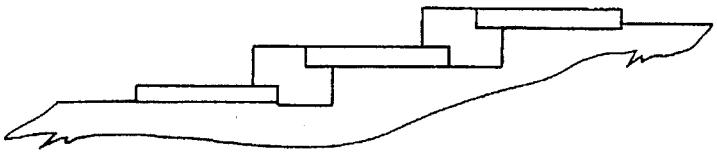
FIG. 2 Prior Art
Figure 3:
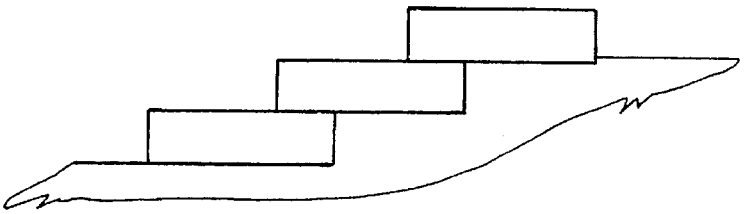
FIG. 3 Prior Art
Figure 4:
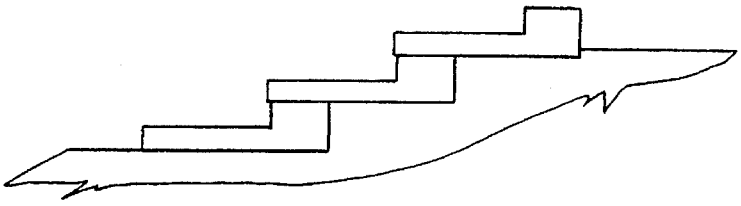
FIG. 4 Prior Art
Figure 5:
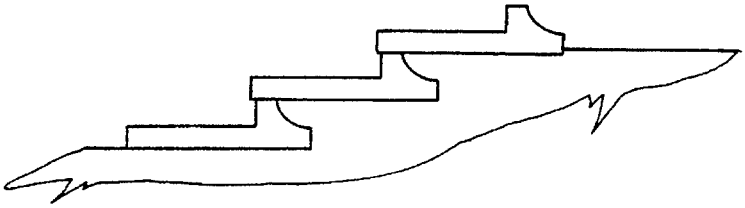
FIG. 5 Prior Art
Figure 1A:
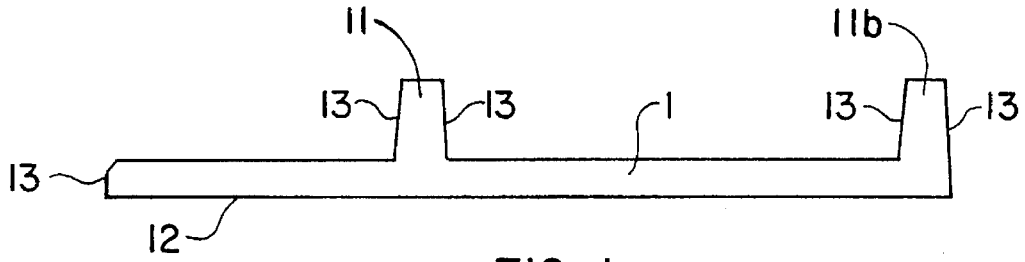
Figure 1B:
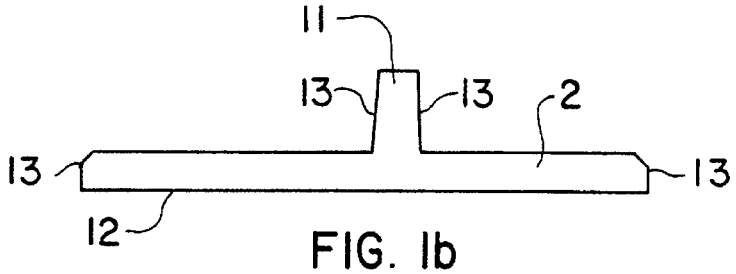
Figure 1C:
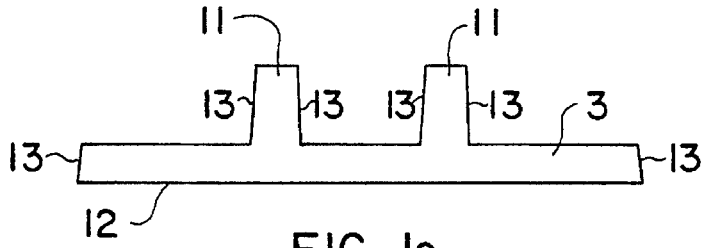
Figure 2A:
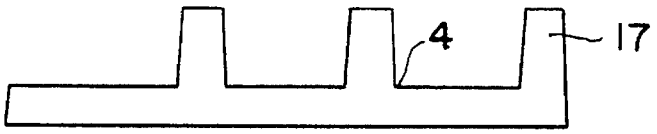
Figure 2B:
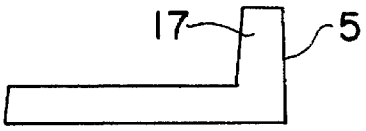
Figure 3A:
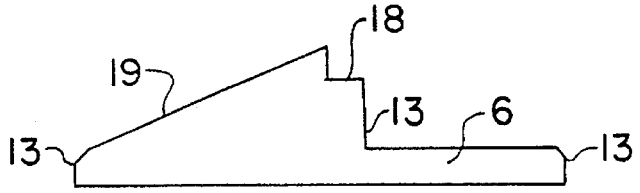
Figure 3B:
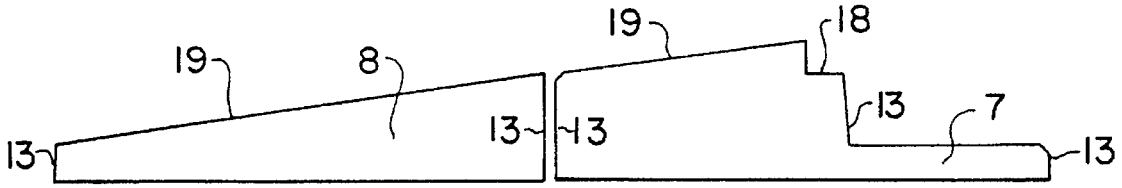
Figure 4A:
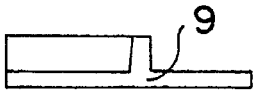
Figure 4B:
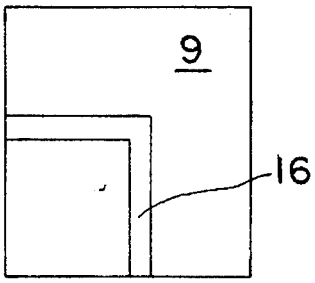
Figure 5A:
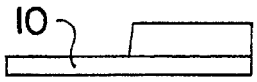
Figure 5B:
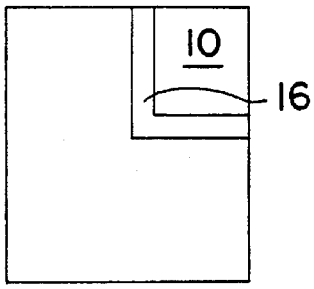
Figure 4C:
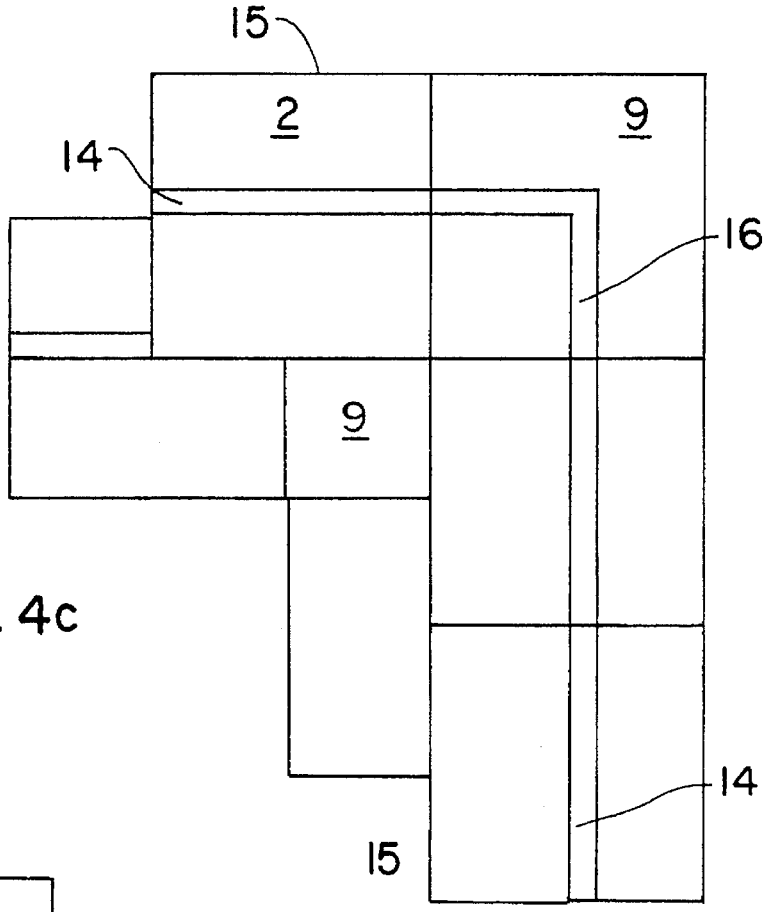
Figure 5C:
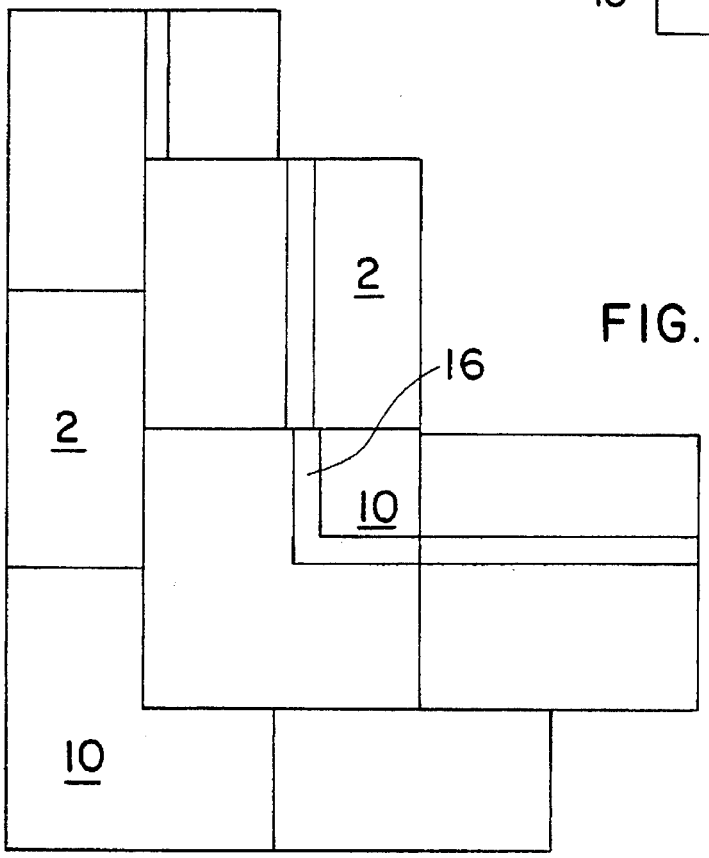
Figure 6:
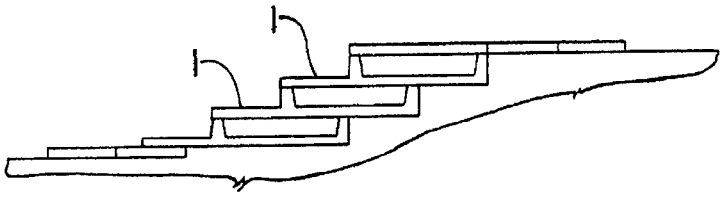
Figure 7:
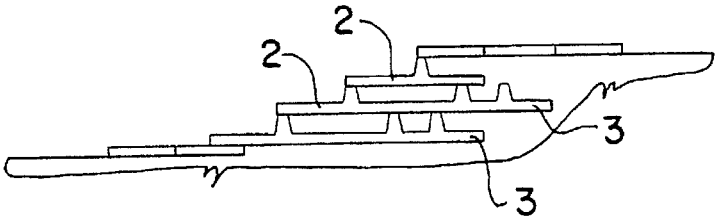
Figure 8:
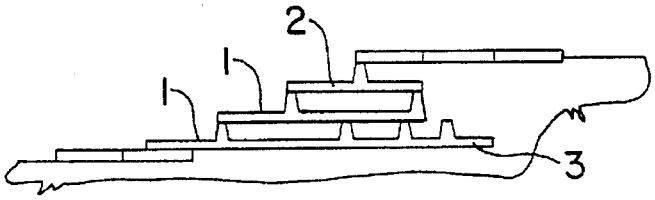
Figure 9:
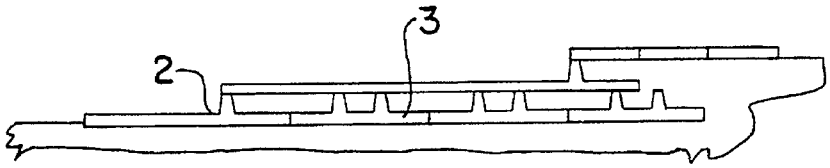
Figure 10:
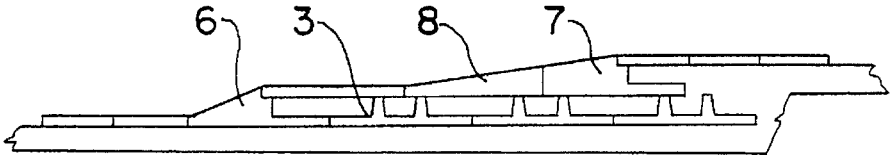
Figure 11:
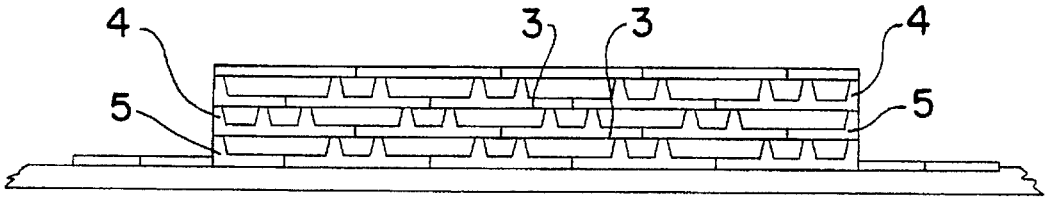
Figure 12:
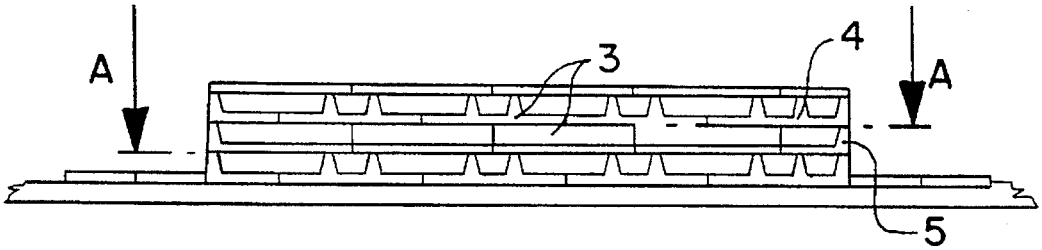
Figure 13:
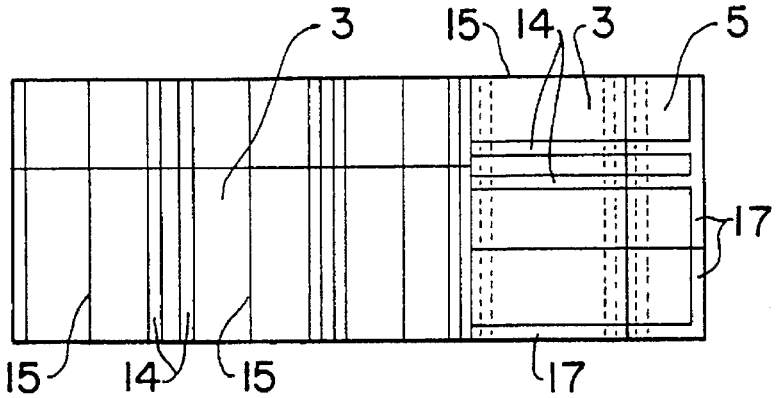
FIG. 13 depicts the platform according to FIG. 12 in a section through A—A. It illustrates the more advantageous distribution of loads by means of upright supports serving as beams, as well as different designs of edge components.
Figure 14:
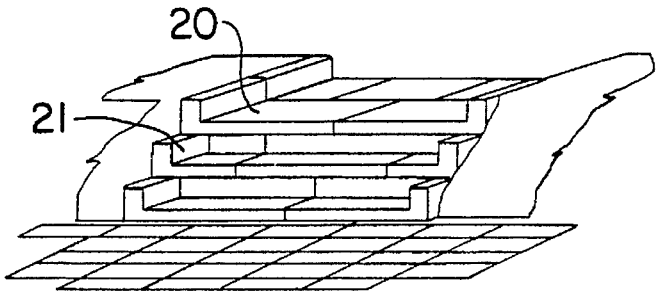
FIG. 14 depicts a stairway embedded in the ground; its edge components are provided with upright edges which form a retainer for a lawn, for example.
Figure 15:
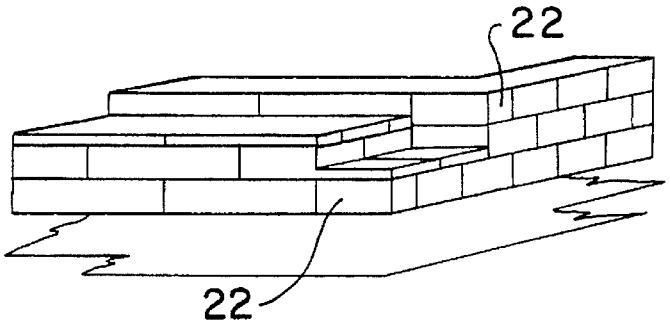
FIG. 15 is a perspective representation of a planting platform and platform steps. All of the edge components have been provided with upright edges to form a closed wall.

The embodiments described and depicted above are only examples of how the component system according to the invention can be applied. It is possible to design and produce in a simple manner strong, safe and neat ground-bearing structures of the desired shape by using the basic components described, together with additional components complying with the same dimensioning, such as slabs, edge components, rounded components, etc. A modification of the inner component 3, wherein one of the supports 11 is broadened to extend to the and of the slab 12 has, for instance, turned out to be very usable and easy to practice. Such an inner element 3 can be used as an edge element as the broadened support forms an upright edge of the compound like the edge support of edge component 4.

I claim:

1. A component system for the building of ground-bearing stairways of one or more layers, comprising at least three different concrete slab components, each component comprising a slab part having an upper surface and one or more upright supports extending from the upper surface of the slab part, said components being arranged close to each other in adjacent upper and underlying layers and the components in each upper layer being in overlapping relationship and connected to the components in the underlying layer, characterized in that each support of each slab component has the same height and an upper surface which is made parallel with the slab, the slab of one slab component in one upper layer covers at least two adjacent supports in the adjacent underlaying layer, the slab components of each upper layer are invisibly connected to the supports of the underlaying layer, all surfaces of the slab component which diverge from the horizontal plane are upright and that at least one of all mutually opposite upright surfaces is inclined inwards and towards the other to enable releasing from a casting mold, and the upright supports of two adjacent slab components in one layer of the stairway form three support and fastening surfaces.

2. A component system for the building of ground-bearing stairways of one or more layers, comprising at least three different concrete slab components, each component comprising a slab part having an upper surface and one or more upright supports extending from the upper surface of the slab part, said components being arranged close to each other in adjacent upper and underlying layers and the components in each upper layer being in overlapping relationship and connected to the components in the underlying layer, characterized in that each support of each slab component has the same height and an upper surface which is made parallel with the slab, the slab of one slab component in one upper layer covers at least two adjacent supports in the adjacent underlaying layer, the slab components of each upper layer are invisibly connected to the supports of the underlaying layer, all surfaces of the slab component which diverge from the horizontal plane are upright and that at least one of all mutually opposite upright surfaces is inclined inwards and towards the other to enable releasing from a casting mold, and at least one of the upper slab components forms an inner part of the stairway and has two upright supports symmetrically in relation to its center, and that a distance from the center of the component to an edge of the inner component corresponds to the step depth. arranged close to each other in adjacent upper and underlying layers and the components in each upper layer being in overlapping relationship and connected to the components in the adjacent underlying layer, characterized in that each support of each slab component has the same height and an upper surface which is parallel with the slab, the slab part of the slab component in one upper layer covers at least two neighboring supports in the adjacent underlaying layer, the bottom surface of each slab part is plane, free of downwardly extending shoulders and perpendicular to the supports, the distance between a front edge of the slab component and an adjacent upright support defines the tread depth of a step of the stairway, the slab components of each upper layer are capable of being invisibly connected to the supports of the underlaying layer, and all surfaces of the slab component which diverge from the horizontal plane are upright and that at least one of all upright surfaces is inclined inward and towards the other to enable releasing of the component from a casting mold.

3. A component system according to claim 1 or 2 characterized in that one of the components constitutes an inner component for the stairway, said inner component having two upright supports, said supports having opposed inner sides symmetrically located in relation to the center of the component, said supports being of the same height and having an upper surface which is parallel with the slab part, and the bottom surface of said slab part being planar and perpendicular to the supports, and further that all surfaces of the slab component which diverge from the horizontal plane are upright and that at least one of all mutually opposite upright surfaces is inclined inward and towards the other to enable releasing from a casting mold.

4. A component system according to claim 1 or 2, characterized in that one of the components constitutes a step component for the stairway, said stem component having two upright supports, one of them being located at a distance of the step depth from the front edge, and the other being located at or near the back edge of the component, and that the depth of the component is three times the step depth, said supports being of the same height and having an upper surface which is parallel with the slab part, and the bottom surface of said slab part being planar and perpendicular to the supports, and further that all surfaces of the slab component which diverge from the horizontal plane are upright and that at least one of all mutually opposite upright surfaces is inclined inward and towards the other to enable releasing from a casting mold.

5. A component system according to claim 1 or 2, characterized in that one of the components constitutes a step component for the stairway, said stem component having one upright support, which is located at the distance of the step depth from the front edge, and that the width of the component is substantially the same as its depth, said support having an upper surface which is parallel with the slab part, and the bottom surface of said slab part being planar and perpendicular to the support, and further that all surfaces of the slab component which diverge from the horizontal plane are upright and that at least one of all mutually opposite upright surfaces is inclined inward and towards the other to enable releasing from a casting mold.

* * * * *